US005900575A

United States Patent [19]

Johansson et al.

[11] Patent Number: 5,900,575

[45] Date of Patent: May 4, 1999

[54] BOTTOM PLATE MEMBER

[75] Inventors: Ingemar Johansson, Kariskoga; Tomas Lager, Karlstad; Lief Linderholt; Christer Sundell, both of Kariskoga, all of Sweden

[73] Assignee: Simbal AB, A Corp. of Sweden, Karlskoga, Sweden

[21] Appl. No.: 08/930,591

[22] PCT Filed: Apr. 10, 1996

[86] PCT No.: PCT/SE96/00469

§ 371 Date: Jan. 26, 1998

§ 102(e) Date: Jan. 26, 1998

[87] PCT Pub. No.: WO96/32610

PCT Pub. Date: Oct. 17, 1996

[30] Foreign Application Priority Data

Apr. 11, 1995 [SE] Sweden ..... 9501344

[51] Int. Cl.[6] ..... F41A 1/08

[52] U.S. Cl. ..... 89/1.706; 89/1.704

[58] Field of Search ..... 89/1.706, 1.705, 89/1.704, 1.703; 102/437; 138/89

[56] References Cited

U.S. PATENT DOCUMENTS

| | | | |
|---|---|---|---|
| 3,614,907 | 10/1971 | Haglund et al. | 89/1.704 |
| 4,739,799 | 4/1988 | Carney et al. | 138/89 |
| 4,902,043 | 2/1990 | Zillig et al. | 138/89 |
| 5,186,214 | 2/1993 | Savard | 138/89 |
| 5,216,194 | 6/1993 | Boire | 89/1.706 |

*Primary Examiner*—Charles T. Jordan
*Assistant Examiner*—Theresa M. Wesson
*Attorney, Agent, or Firm*—John T. Roberts

[57] ABSTRACT

The invention relates to a bottom plate member (6) which is designed and made for initially tightening a chamber in which a high gas pressure is generated, for example the propellant charge chamber (4) in an ammuniton round for a recoilless weapon system or in pipes or containers within the process industry. The plate member (6) is breakable and opens for the gases to exit when the gas pressure within the chamber exceeds a certain level. The plate member has a through hole (12) in the center which gives an effective starting point for the cracking process as well as fractural impressions (10) to control the cracking process so that the plate is divided into a number of well defined parts of flaps (11) which are connected to each other. The plate member (6) further comprises a number of straight edges (16), which number corresponds to the number of flaps (11), against which edges the base of the flaps are arranged to be folded when the plate member opens due to the gas pressure.

7 Claims, 2 Drawing Sheets

BOTTOM PLATE MEMBER

This invention relates to a bottom plate member which is designed and made for initially tightening a chamber in which a high gas pressure is generated. Examples of such chambers can be found in ammunition rounds for recoilless weapons but also in pipes and containers within the process industry. Specifically, the invention relates to a bottom plate member which is located at the rear end of a propellant charge chamber of an ammunition round for a recoilless weapon. Initially the bottom plate member provides a tightening and barrier for the propellant gases, for instance gases of powder, generated in the chamber when the round is fired, but is broken when the gas pressure within the chamber exceeds a certain level so that the gases are allowed to exit from the rear end of the ammunition round.

Bottom plate members of this type have previously been used in ammunition rounds for recoilless weapon systems. It is the gas outlet rearwards, when the rear bottom plate is broken, that makes the weapon recoilless. It is also previously known to use similar bottom plates as so-called blasting foils in the process industry, in which the function of the bottom plate is to break and evacuate the gases as soon as an inadmissible gas pressure is generated in a pipe or a container.

When the bottom plate is broken it is thrown rearwards with great force and it is a high risk that personnel and equipment behind the weapon or the process equipment in question will be damaged. This is a well-known problem to which one has tried to find a solution by providing the plate with fractural impressions which divides the plate into a number of smaller and then less dangerous parts.

It has turned out, however, that the methods that have been used so far for reducing the risks for personal injuries and other damages have been unsatisfactory. Even those fragments which are coming from the broken bottom plate could hurt persons that are staying behind the weapon. On the whole, previously known methods with fractural impressions, light-weight bottom plate materials or the like, have not been satisfactory with respect to a safe and predictable process for the gas outlet.

The object of this invention is to solve the problems that have been discussed above and provide a more controlled and splinterfree process for the opening of the plate so that a substantially 100% safety is achieved for this process. According to the invention this is achieved by providing the bottom plate with a through hole in the center which gives an effective starting point for the cracking process, fractural impressions for controlling the cracking process so that the plate after the cracking start is divided into a number of well defined flaps, but which are connected to each other, and a number of straight edges, which number corresponds to the number of flaps, against which edges the base of the flaps are arranged to be folded when the plate is opened up due to the gas pressure.

Figure 1:
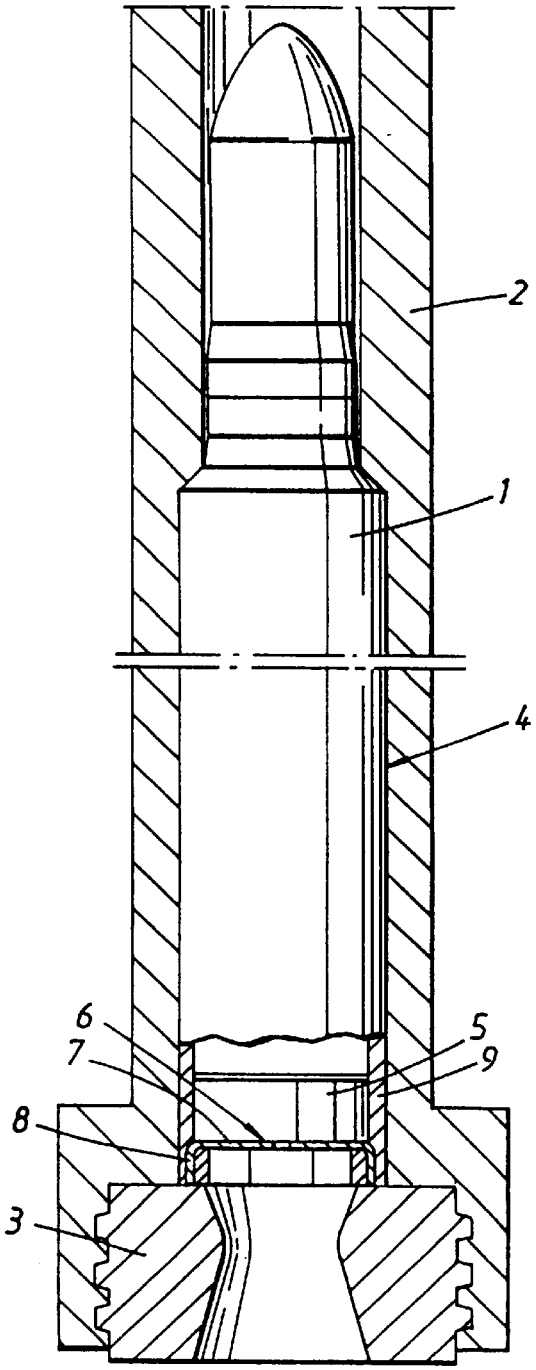
Figure 2:
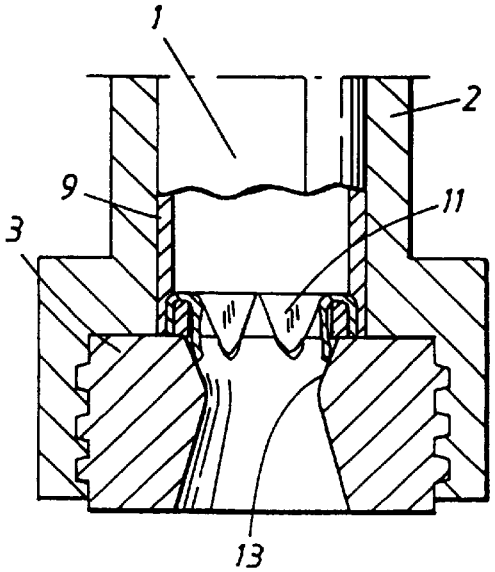
Figure 3:
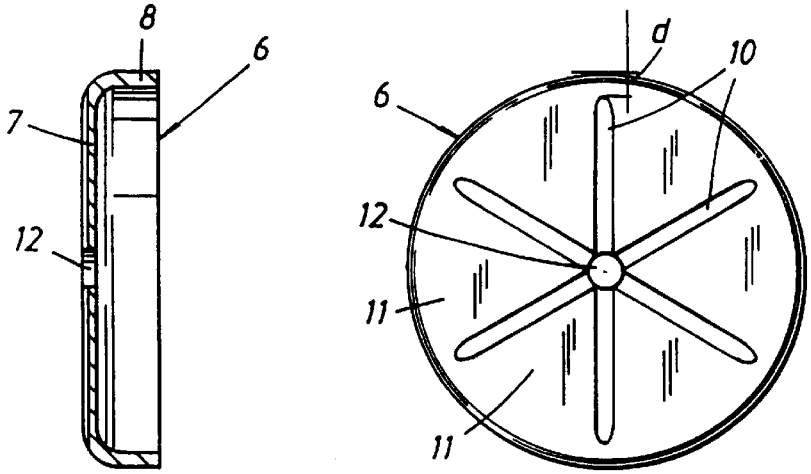
Figure 4:
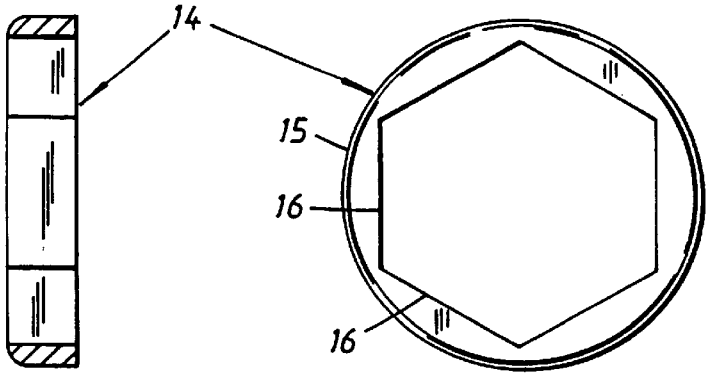
Figure 5:
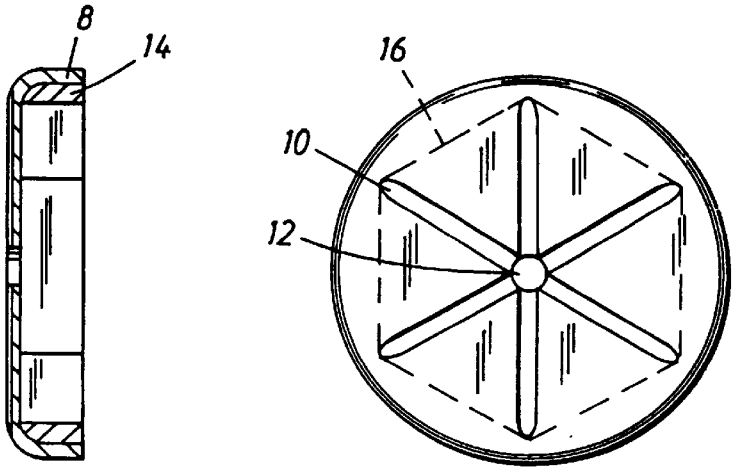

One embodiment of the invention is schematically illustrated in the accompanying drawings, in which FIGS. 1 and 2 show a complete ammunition round for a recoilless weapon system before firing as well as after firing, FIG. 3 shows the bottom plate with the fractural impressions more in detail, FIG. 4 shows an insert member for the bottom plate and FIG. 5 shows the two members bottom plate and insert member put together.

FIG. 1 shows a complete ammunition round 1 in firing position in a launching barrel 2 of a recoilless weapon system, for example a 20 mm ammunition round he launching barrel 2 has a rear conventional nozzle 3 for the exhausting propellant gases. The ammunition round 1 comprises a chamber 4 with a propellant charge therein and a detonator 5. A bottom plate 6 is located at the rear end of the chamber 4 for tightening the chamber and providing a barrier for the generated powder gases so that an efficient ignition over the propellant charge is guaranteed. The bottom plate consists basically of a comparatively thin, circular disc 7 and a flange 8 arranged at the rearmost part of the chamber wall 9.

The bottom plate 6 is dimensioned so that it is broken and blown open by the gases as soon as a specific gas pressure has been reached within the chamber. It is this gas pressure that makes the weapon recoilless.

As already mentioned in the introductory portion of the specification it is very important that the plate itself, when forced backwards by the gas pressure, or small fragments from the broken plate, does not hurt persons staying behind the weapon. According to the invention, therefore, the plate member has been designed and made in such a way that basically 100% safety against such small and harmful fragments is guaranteed when the plate member is opened up by the gas pressure.

The design of the bottom plate is illustrated more in detail in FIG. 3 by means of a front view as well as a cross-section. As illustrated in the figure the circular disc part 7 of the plate member has a star fracture so that six flaps 11 are formed. The star-shaped fractural impression is made by means of material-reducing notches in the plate, in this case six symmetrically arranged notches 10. The notches are not extending all the way to the periphery of the plate, but end up at a certain distance d from the edge of the plate so that an integral, annular part with no material reductions is remained. In addition to the star fracture the center of the plate has a through hole 12. The hole is small compared to the dimension of the plate, specifically the diameter of the hole is approximately 10% of the plate diameter. As this hole 12 is a through hole and located in the center of the plate it provides an efficient starting point for the cracking process. With fractural impressions 10 alone, it has turned out that small fragments are broken away from the central portion of the plate 6 which fragments might be harmful for personnel and/or equipment. By introducing the through hole in the center of the plate the risk for such undesired fragments is substantially reduced, the central portion of the plate which otherwise might give rise to said loose fragments is simply removed from the beginning.

The through hole in the plate has also another purpose. When the propellant charge is ignited a high-amplitude pressure peak is obtained which might give rise to a pendulum pressure in the chamber. The hole 12 in the plate has a damping ability with respect to such pressure peak and reduces the risk of dangerous pendulum-type pressure.

FIG. 2 illustrates the ammunition round 1 after firing with the now empty propellant charge chamber and the opened bottom plate 6. The flaps 11 of the plate have been bent backwards and bear against the inner wall of the nozzle with their tips. In order to obtain an even more controlled and predictable opening process for the plate and thereby reducing the risk for fragments to be separated from the flaps when they are bent backwards by the gas pressure, the bottom plate member comprises a ring-shaped insert member or reinforcing section 14, see FIG. 4, which insert member abuts the flange 8 of the bottom plate with its outer, circumferential surface 15 and which has a hexagonal inner part, i.e. six straight edges 16 against which the base portions of the flaps are bent back substantially. Thereby the risk for damages due to tear forces in the base portion of the flaps, when the bottom plate is blown up by the gas pressure, is substantially reduced. In order to minimize the cost for the bottom plate it is made as two parts, the tightening part 6 with the fractional impressions and the insert member 14 with the straight edges against which the flaps are bent. In FIG. 5 these two parts are shown put together by means of press fitting.

The bottom plate itself according to FIG. 3 is preferably made of a ductile stainless steel material. The insert member 14 for the plate, see FIG. 4, is preferably made of a sintered stainless steel material or made from a rod-shaped material which is finish-turned on its outer surface and then cut off in suitable lengths.

The invention is not limited to the embodiment which has been illustrated so far but can be varied within the scope of the accompanying claims. Specifically, it should be understood that the bottom plate also could be made as a unitary member, in which case the straight edges 16 against which the flaps are bent are made directly in the flange 8 of the bottom plate itself. In the described embodiment the fractional impression is made as a starshaped pattern so that six flaps are formed when the bottom plate is blown up. Of course any other pattern formed by the fractional impressions can be used so that the number of flaps can be varied. It is then important, however, that the flaps are so designed so that they are not exposed to any fractional forces anywhere in the flap material which forces are too high as it would otherwise be a risk for loosened small fragments. The insert member 14 is made with a number of straight edges, which number corresponds to the number of flaps, which means that each flap has a straight edge to be bent around upon the release of gas pressure.

The hole 12 has been illustrated as a through hole, but it is understood that the hole can be sealed by means of a foil or the like to make the chamber damp-proof, especially during transport and storage. Such a thin sealing member does not change the described function of the hole 12, however.

The invention has been described in connection with a propellant charge chamber for a recoilless weapon system. It should be understood that the bottom plate can be used also in other applications in which a controlled opening of a plate is required when a certain pressure has been exceeded. Examples of such applications can be found in the process industry.

We claim:

1. A bottom plate member forming a wall of a propellant charge chamber which is breakable to allow gases to exit when the pressure exceeds a certain level;

a) said bottom plate member comprising an disc and a reinforcing section, said disc being located between the propellant charge chamber and the reinforcing section;

b) said disc having a central thru hole where the gases initially exit the chamber;

c) said disc having fractural impressions for controlling the breaking, said fractural impressions extending radially from the central thru hole toward the periphery of the disc;

d) said reinforcing section having a central aperture exposing a majority of the area of the disc;

e) said central aperture of the reinforcing section having edges against which the disc rests before the propellant is exploded;

f) said disc separating along the fractural impressions and folding backwardly away from the propellant charge chamber along the edges of the reinforcing section forming multiple flaps which are attached to the retained outer portion of the disc, but separated at the inner portion; and, g) said flaps folding back substantially 90° C. when the propellant is exploded;

whereby the entire disc is retained by the charge chamber when the propellant is exploded.

2. A bottom plate member according to claim 1, characterized in that the fractural impressions are material-reducing notches.

3. A bottom plate member according to claim 2, characterized in that the material-reducing notches extend from the central thru hole in a star-shaped pattern.

4. A bottom plate member according to claim 1, characterized in that the diameter of the thru hole is about 10% of the diameter of the disc.

5. A bottom plate member according to claim 1, comprising a circular disc with fractural impressions and a central thru hole, and a peripheral flange, within the wall of said propellant charge chamber.

6. A bottom plate member according to claim 5, characterized in that the bottom plate member is made of two parts, the disc integrally attached to a first flange at the circumference of the disc, said first flange having an inner and an outer side, said reinforcing section integrally attached to a second flange at the circumference of the reinforcing section, said second flange fitting within the inner side of the first flange, said reinforcing section having an hexagonal central aperture.

7. A bottom plate member according to claim 6, characterized in that the disc is a ductile material and the reinforcing section is a rigid material, whereby the flaps are bent around the edges of the aperture of the reinforcing section.

* * * * *